US006183397B1

(12) United States Patent
Stearns et al.

(10) Patent No.: US 6,183,397 B1
(45) Date of Patent: Feb. 6, 2001

(54) MULTI-FUNCTIONAL EXERCISE METHODS AND APPARATUS

(76) Inventors: Kenneth W. Stearns, P.O. Box 55912, Houston, TX (US) 77055; Joseph D. Maresh, P.O. Box 645, West Linn, OR (US) 97068-0645; Mark A. Krull, 1705 E. Ridge Ct., Northfield, MN (US) 55057

( * ) Notice: Under 35 U.S.C. 154(b), the term of this patent shall be extended for 0 days.

(21) Appl. No.: 09/318,072

(22) Filed: May 25, 1999

(51) Int. Cl.[7] ..... A63B 22/00; A63B 23/04

(52) U.S. Cl. ..... 482/52; 482/51

(58) Field of Search ..... 482/51–53, 57, 482/70, 71, 79, 80

(56) References Cited

U.S. PATENT DOCUMENTS

| | | | | |
|---|---|---|---|---|
| 5,242,341 | * | 9/1993 | Yeh | 482/52 |
| 5,857,940 | * | 1/1999 | Husted | 482/51 |
| 6,063,008 | * | 5/2000 | Mcbride et al. | 482/57 |

* cited by examiner

*Primary Examiner*—Stephen R. Crow

(57) ABSTRACT

An exercise apparatus has arm driven members and leg driven members which are movably mounted on a frame. The arm driven members are pivotal relative to the frame, and the leg driven members are movable through various paths relative to the frame. The arm driven members and the leg driven members may be connected to one another and/or the frame to provide facilitate different modes of exercise activity. Also, the leg driven members may be constrained to move through several different fixed paths.

19 Claims, 3 Drawing Sheets

MULTI-FUNCTIONAL EXERCISE METHODS AND APPARATUS

FIELD OF THE INVENTION

The present invention relates to exercise methods and apparatus and more particularly, to exercise equipment which facilitates various leg exercise motions.

BACKGROUND OF THE INVENTION

Exercise equipment has been designed to facilitate a variety of lower body exercise motions. For example, treadmills allow a person to walk or run in place; stepper machines allow a person to climb in place; bicycle machines allow a person to pedal in place; other machines allow a person to skate and/or stride in place; and still other machines guide a person's feet through elliptical paths of travel. Yet another exercise apparatus, disclosed in U.S. Pat. No. 5,290,211 to Stearns, is designed to facilitate several different leg exercise motions, including free form paths of foot movement and controlled paths of foot movement comparable to walking, running, stepping, cycling, striding, skiing, and/or elliptical motion.

Exercise equipment has also been designed to facilitate upper body exercise together with lower body exercise. For example, many of the foregoing types of exercise equipment have been provided with reciprocating cables or pivoting arm poles to facilitate contemporaneous upper body and lower body exercise.

SUMMARY OF THE INVENTION

The present invention provides an exercise apparatus having foot supports which are selectively movable through various paths at the discretion of the user. Each foot support is rigidly secured to a lower rocker link, which in turn, is pivotally connected to an upper rocker link. The upper rocker links are pivotally connected to a frame at respective pivot points disposed on opposite sides of a person's hips. The upper rocker links are constrained to pivot back and forth in reciprocal fashion relative to one another, and the lower rocker links are constrained to pivot up and down in reciprocal fashion relative to one another.

On the preferred embodiment, the upper rocker links may be selectively locked relative to the frame, thereby constraining the foot supports to pivot up and down in a stair-stepping mode. In the alternative, the lower rocker links may be selectively locked relative to respective upper rocker links, thereby constraining the foot supports to pivot back and forth in a gliding mode. In yet another mode of operation, the foot supports may be keyed to tracks provided in side panels disposed on opposite sides of the frame, thereby constraining the foot supports to move through a prescribed path. In addition to providing tracks for the foot supports, the side panels provide lateral support for the foot supports, thereby enhancing the structural integrity of the apparatus.

The preferred embodiment also provides handles which may be selectively used in different modes of operation. For example, in a first mode of operation, the handles and the foot supports are independently movable relative to the frame. In a second mode of operation, the handles and the upper rocker links are constrained to move together relative to the frame. In a third mode of operation, the handles are locked to the frame to provide a rigid support during movement of the foot supports. In a fourth mode of operation, the upper rocker links are locked to the frame together with the handles, thereby placing the apparatus in the stair climbing mode described in the preceding paragraph. Many advantages and improvements of the present invention may become apparent from the more detailed description that follows.

BRIEF DESCRIPTION OF THE DRAWING

With reference to the Figures of the Drawing, wherein like numerals represent like parts throughout the several views.

DESCRIPTION OF THE DEPICTED EMBODIMENT

Figure 1:
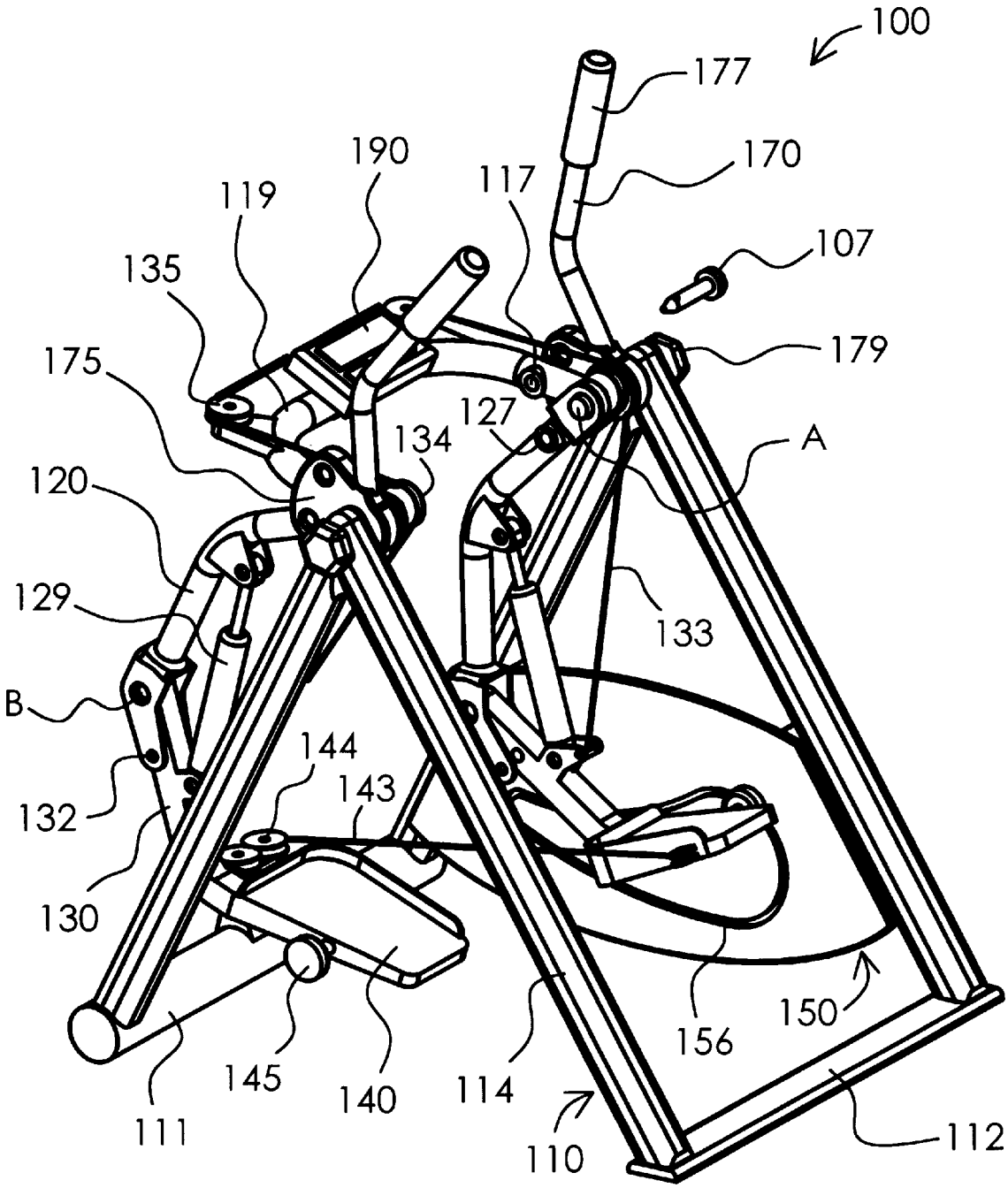
FIG. 1 is a perspective view of an exercise apparatus constructed according to the principles of the present invention.
Figure 2:
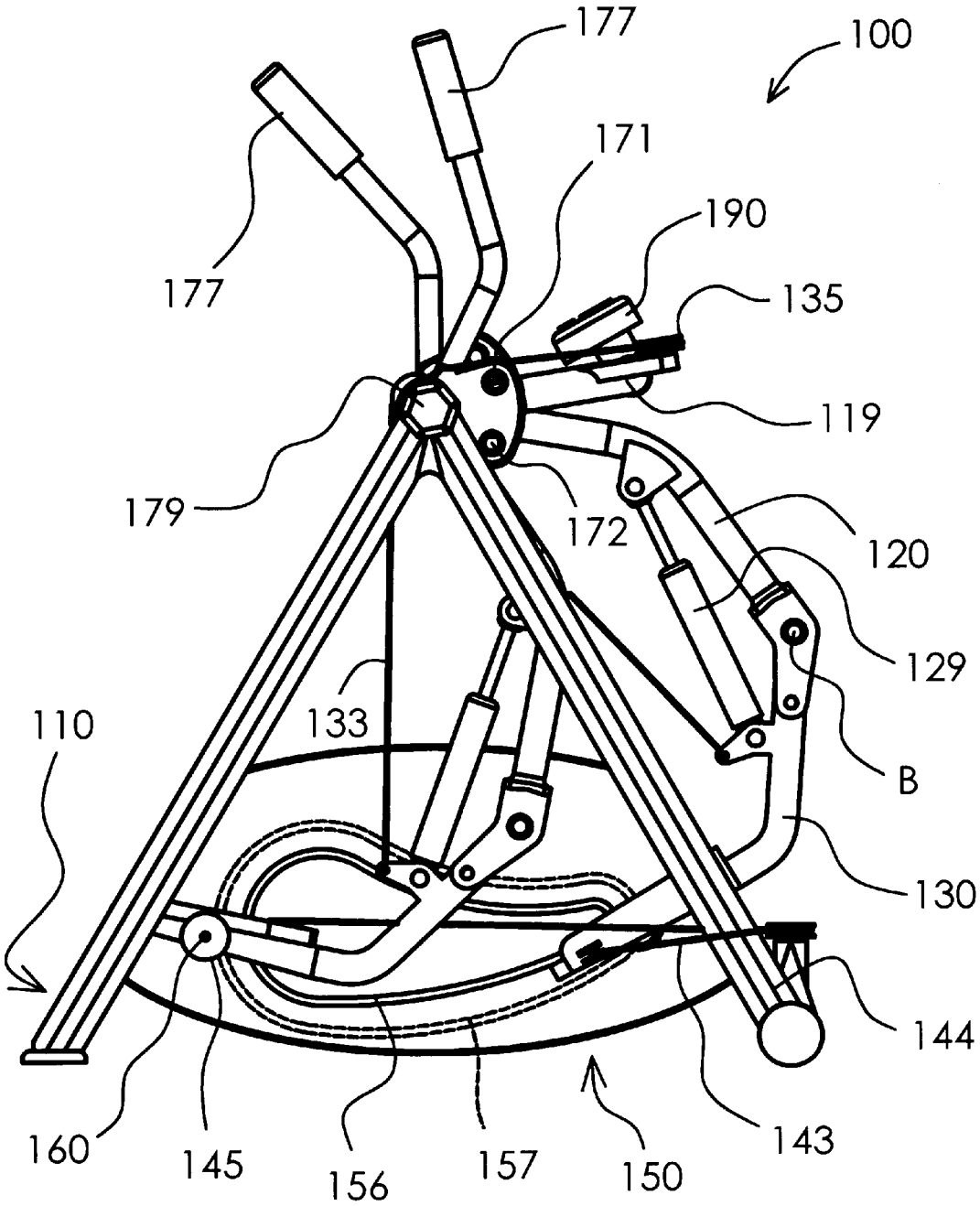
FIG. 2 is a side view of the exercise apparatus of FIG. 1.
Figure 3:
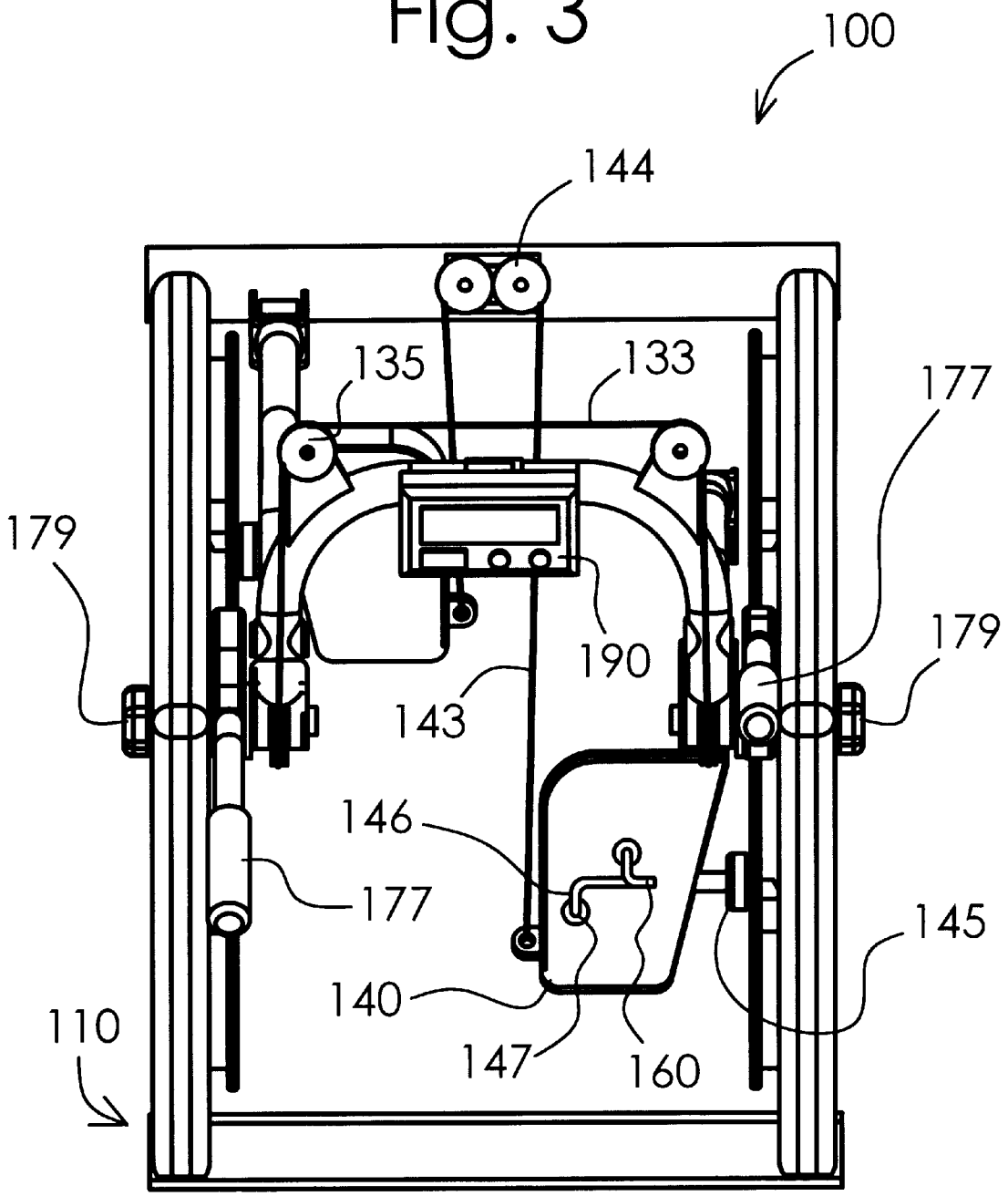
FIG. 3 is a top view of the exercise apparatus of FIG. 1.

A preferred embodiment exercise machine constructed according to the principles of the present invention is designated as 100 in FIGS. 1–3. Many of the features and advantages of the machine 100 are taught or suggested by U.S. Pat. No. 5,290,211 to Stearns, which patent is incorporated herein by reference. Generally speaking, the machine 100 includes a frame 110, handles 177 which are selectively pivotal relative to the frame 110, and foot supports 140 which are selectively movable in various paths of motion relative to the frame 110.

The machine 100 is generally symmetrical about a vertical plane extending longitudinally through center of the frame 110, except that certain parts on opposite sides of the plane of symmetry are out of phase with one another. As a result, like reference numerals are used to designate both the "right-hand" and "left-hand" parts on the apparatus 100, and in general, when reference is made to one or more parts on only one side of the apparatus, it is to be understood that corresponding part(s) are disposed on the opposite side of the apparatus 100.

The frame 110 includes left and right stanchions 114 which have inverted V-shaped configurations. A transverse tube 111 is interconnected between forward ends of the stanchions 114, and a transverse bar 112 is interconnected between rearward ends of the stanchions 114. The tube 111 and the bar 112 cooperate to support the machine 100 in stable fashion relative to an underlying floor surface. A U-shaped member 119 is interconnected between the vertices of the stanchions 114 and extends toward the front end of the machine 100. An electronic device 190, with a display screen and input buttons, is mounted on the member 119 to provide an interface between the machine 100 and a person using the machine 100.

A respective leg exercise assembly is interconnected between the frame 110 and each foot support 140. Each such assembly includes a first leg driven member or upper rocker link 120, which is movably connected to the frame 110 and movable relative thereto within a vertical plane, and a second leg driven member or lower rocker link 130 which is movably connected to the first leg driven member 120 and movable relative thereto within the same vertical plane. On the preferred embodiment 100, each upper rocker link 120 is rotatable about a common axis A relative to the frame 110, and each lower rocker link 130 is rotatable about a respective axis B relative to a respective upper rocker link 120. Each foot support 140 is rigidly connected to a lower end of a respective lower rocker link 130.

A motion impeding device, in the form of a dampening cylinder 129, is rotatably interconnected between the upper leg driven member 120 and the lower leg driven member 130, to dampen pivotal movement of the former relative to the latter. A resistance mechanism, in the form of a helical spring, for example, may be added to the dampening cylinder 129 to impose an upward bias on the lower leg driven member 130 relative to the upper leg driven member 120. Such an arrangement is disclosed in U.S. Pat. No. 5,072,928 to Stearns, which patent is incorporated herein be reference.

A flexible connector 133 extends from a first end, connected to a trunnion on the right, lower leg driven member 130, upward and about a pulley 134 mounted on the vertex of the right side stanchion 114, forward and about a pulley 135 mounted on the U-shaped member 119, to the left and about another pulley 135 mounted on the opposite side of the U-shaped member 119, rearward and about another pulley 134 mounted on the vertex of the left side stanchion 114, and finally, downward to a second end, connected to a trunnion on the left, lower leg driven member 130. The connector 133 constrains the foot supports 140 to move up and down in reciprocal fashion relative to one another, consistent with the disclosure of U.S. Pat. No. 5,290,211.

A flexible connector 143 has a first end connected to the inside of the right foot support 140, a second end connected to the inside of the left foot support 140, and an intermediate portion routed about adjacent pulleys 144 mounted on the forward frame member 111. The connector 143 constrains the foot supports 140 to move back and forth in reciprocal fashion relative to one another, again consistent with the disclosure of U.S. Pat. No. 5,290,211.

Opposing flanges extend downward from each upper leg driven member 120 and along opposite sides of a respective lower leg driven member 130. Holes 132 extend through the flanges and align with a hole in respective lower leg driven members 130 (see the right side member 130 in FIG. 1) when the two foot supports 140 occupy like orientations relative to the underlying floor surface. A pin may be inserted through the aligned holes in each upper leg driven member 120 and corresponding lower leg driven member 130 to prevent pivoting of the latter relative to the former. In this configuration, each of the foot supports 140 is constrained to move back and forth through an arc centered about the axis A.

Side panels 150 are mounted on respective stanchions 114 to enhance the structural integrity of the apparatus 100. Each side panel 150 provides a low friction bearing surface which faces toward an adjacent foot support 140. A bearing member 145 is mounted on the outside of each foot support 140 and bears against a respective panel 150. On the preferred embodiment 100, the bearing members 145 are low friction pads, but those skilled in the art will recognize that other suitable members, such as casters, may be used in the alternative. The panels 150 provide lateral support for the foot supports 140, thereby reducing potentially destructive side loading on the shafts at the pivot axes A and B.

Grooves or tracks 156 may be formed in the side panels 150 to provide a desirable fixed path of travel for the foot supports 140. A second groove 157 is shown in dashed lines in FIG. 2 to emphasize that more than one fixed path may be provided. As shown in FIGS. 2 and 3 with reference to the right foot support 140, a pin 160 may be mounted on the foot support 140 and selectively moved to a laterally extended position which engages the groove 156 in the adjacent side panel 150. A cavity 146 is provided in the upper surface of the foot support 140 to accommodate the pin 160 in either the extended position or a second, retracted position. Openings 147 are provided to facilitate access of the pin 160 for purposes of moving it from one position to the other. During exercise activity, the pin 160 is covered by a person's foot, thereby preventing accidental movement from one position to the other.

The handles 177 are sized and configured for grasping by a person standing on the foot supports 140. Each handle 177 is supported by an arm driven member 170 which is connected to the frame 110 and movable relative thereto in a vertical plane. On the preferred embodiment 100, a lower portion of each arm driven member 170 is connected to a plate member 175 which rotates about the axis A relative to a respective frame member 114. In other words, both the arm driven members 170 and the upper leg driven members 120 rotate about a common axis A. Knobs 179, disposed outside the stanchions 114, are rotatable to compress at least one friction pad against respective plate members 175 for purposes of providing adjustable resistance to rotation of the arm driven members 170 relative to the frame 110.

On each side of the apparatus 100, a pin 107 may be selectively inserted through aligned holes 171 and 117 in the arm driven member 170 and the frame member 119, respectively, to lock the arm driven member 170 against rotation relative to the frame 110. In this configuration, the upper rocker links 120 are free to pivot forward and rearward relative to the frame 110 and the arm driven members 170. In addition, another pin 107 may be inserted through aligned holes 172 and 127 in overlapping portions of the arm driven member 170 and the upper rocker link 120, respectively, to lock the two members 120 and 170 together, thereby locking the upper rocker link 120 against pivoting relative to the frame 110. In this configuration, each of the foot supports 140 is constrained to move up and down through an arc centered about the axis B.

In the alternative, the pin 107 may be removed from the holes 171 and 117 and then inserted through aligned holes 172 and 127 in overlapping portions of the arm driven member 170 and the upper rocker link 120, respectively, to lock the two members 120 and 170 together. In this configuration, forward and rearward movement of either foot driven member 120 is linked to rearward and forward pivoting of a respective handle 177. In yet another configuration, the pins 107 may be removed altogether, leaving the arm driven member 170 and the leg driven member 120 free to move relative to one another and the frame 110.

With all of the pins 107 removed, the upper rocker links 120 are movable relative to the frame 110, and the lower rocker links 130 are movable relative to the upper rocker links 120. As a result, the foot supports 140 are movable in reciprocal, yet variable paths relative to the frame 110. In this state, the foot supports 140 may be moved in free form fashion or keyed to the side panels for a fixed path which resembles a natural walking motion.

Although only a preferred embodiment and a specific application are described herein, this disclosure will likely cause those skilled in the art derive additional embodiments, modifications, and/or applications. Accordingly, the scope of the present invention should be limited only to the extent of the claims which follow.

What is claimed is:

1. An exercise apparatus, comprising:

a frame having a front end, a rear end, and opposite left and right support structures disposed therebetween and left and right support panels;

left and right upper rocker links pivotally connected to respective support structures at axially aligned positions;

left and right lower rocker links pivotally connected to respective upper rocker links;

left and right foot supports rigidly connected to respective lower rocker links; and means located on at least one said support panel for selectively constraining said left and right foot supports to move through a fixed path of motion.

2. The exercise apparatus of claim 1, wherein said means includes a pin mounted on at least one of said foot supports and selectively movable into a corresponding closed curve track secured to said at least one said support panel.

3. The exercise apparatus of claim 2, wherein said means further includes a flexible connector having opposite ends connected to respective foot supports, and an intermediate portion routed about at least one pulley on said frame.

4. The exercise apparatus of claim 3, wherein said means further includes a flexible connector having opposite ends connected to respective lower rocker links, and an intermediate portion routed about at least one pulley on said frame.

5. The exercise apparatus of claim 2, wherein said at least one of said foot supports bears against at least one said support panel laterally displaced support panel on said frame.

6. The exercise apparatus of claim 5, wherein said track is a groove formed in said panel.

7. The exercise apparatus of claim 1, wherein said at least one of said foot supports bears against at least one said support panel laterally displaced support panel on said frame.

8. The exercise apparatus of claim 1, wherein said means further includes a flexible connector having opposite ends connected to respective lower rocker links, and an intermediate portion routed about at least one pulley on said frame.

9. The exercise apparatus of claim 1, wherein said means includes pins selectively inserted through aligned holes in respective upper rocker links and respective lower rocker links.

10. The exercise apparatus of claim 9, wherein said means further includes a flexible connector having opposite ends connected to respective foot supports, and an intermediate portion routed about at least one pulley on said frame.

11. The exercise apparatus of claim 1, wherein said means includes means for locking said upper rocker links against rotation relative to said frame.

12. The exercise apparatus of claim 11, wherein said means further includes a flexible connector having opposite ends connected to respective lower rocker links, and an intermediate portion routed about at least one pulley on said frame.

13. The exercise apparatus of claim 1, further comprising left and right handles pivotally connected to respective support structures at said axially aligned positions, wherein pins are selectively inserted into aligned holes in respective upper rocker links and respective handles to constrain respective upper rocker links and handles to rotate together.

14. The exercise apparatus of claim 13, wherein additional pins are selectively inserted into aligned holes in respective handles and said frame to lock said handles and said upper rocker links against rotation relative to said frame.

15. An exercise apparatus, comprising:

a frame having a front end, a rear end, and opposite left and right support structures disposed therebetween and left and right support panels each having a bearing surface;

left and right upper rocker links pivotally connected to respective support structures at axially aligned positions;

left and right lower rocker links pivotally connected to respective upper rocker links;

left and right foot supports rigidly connected to respective lower rocker links, wherein said left and right foot supports are laterally supported by said respective bearing surfaces on respective side panels mounted on said frame.

16. The exercise apparatus of claim 15, wherein at least one circuitous track is formed in each of said side panels, and each of said foot supports is selectively constrained to travel along a respective track.

17. The exercise apparatus of claim 15, further comprising left and right handles pivotally connected to respective support structures at said axially aligned positions.

18. The exercise apparatus of claim 17, wherein said handles and respective upper rocker links are selectively lock against rotation relative to one another.

19. The exercise apparatus of claim 18, wherein said handles and respective upper rocker links are selectively locked against rotation relative to said frame.

* * * * *